United States Patent [19]

Kiernan

[11] Patent Number: 4,899,877

[45] Date of Patent: Feb. 13, 1990

[54] PACKAGING OF TOOLS

[75] Inventor: Vincent J. Kiernan, Hudson, Ohio

[73] Assignee: Bares Group, Chagrin Falls, Ohio

[21] Appl. No.: 310,306

[22] Filed: Feb. 13, 1989

[51] Int. Cl.[4] ..... B65D 75/02

[52] U.S. Cl. ..... 206/349; 206/376; 206/470; 206/471; 206/815

[58] Field of Search ..... 206/349, 376, 379, 461, 206/467, 470, 471

[56] References Cited

U.S. PATENT DOCUMENTS

| | | | |
|---|---|---|---|
| 3,516,585 | 6/1970 | Inwood | 206/349 |
| 4,019,632 | 4/1977 | Greenlee | 206/349 |
| 4,165,805 | 8/1979 | Fethke et al. | 206/349 |
| 4,179,029 | 12/1979 | Fethke et al. | 206/349 |
| 4,260,057 | 4/1981 | Wall-Anderson | 206/379 |
| 4,331,237 | 5/1982 | Edell | 206/461 |
| 4,450,961 | 5/1984 | Bies et al. | 206/349 |

*Primary Examiner*—Jimmy G. Foster

[57] ABSTRACT

A packaging technique which have a rotatable member and a stationary member such as an adjustable nut driver of chuck. The package encloses the tool and has at least one transparent section to reveal at least a portion of the tool, and a pair of access openings spaced about 180° to allow manual digital access to the tool. Means are provided to restrain the stationary member of the tool upon rotation of the moveable member to thereby permit a perspective customer to manipulate the tool as well as view it visually.

10 Claims, 4 Drawing Sheets

PACKAGING OF TOOLS

BACKGROUND OF THE INVENTION

In the packaging and display of various type tools, it is often desirable to be able to display a particular tool or a portion of a particular tool to allow the purchasing public to examine the tool yet provide protection for the tool by the packaging material. This is conventionally done by various types of transparent packaging which packaging encloses the particular tool and allows the tool to be mounted on various types of display racks or placed on display shelves so that the tool can be seen yet protected. The packaging also serves the function of providing instructions which are packaged with the tool and various other diagrams and advertising material which are associated with the tool.

However, this packaging of certain types of tools have certain drawbacks. In particular, tools like chucks or adjustable nut drivers wherein the tool is manipulated for various settings have traditionally prevented the customer from testing the operability of this tool and determining from both a visual and a tactile perspective the operation of the tool. Specifically, the prior art types of packaging of chucks and adjustable nut drivers have not allowed the prospective purchaser to rotate the barrel to determine how the jaws and barrel cooperate to work.

While there have been several different prior art packages which allow various types of observation and manipulation such as are illustrated in U.S. Pat. Nos. 4,019,632; 4,165,805; 4,179,029; 3,809,226; 3,891,088; and 3,404,774; nevertheless, there have been no tool packages which allow the purchaser to manipulate rotatable portions of a packaged tool while maintaining a non-rotatable portion stationary to observe the action of the tool as well as to observe the configuration and other aspects of the tool.

SUMMARY OF THE INVENTION

According to the present invention, a tool and package are provided which allows a prospective purchaser to both view the configuration of the tool and also operate the tool to observe its functional characteristics. The packaging comprises in combination a tool having a rotatable member and a non-rotatable member enclosed in a package. The package has at least one transparent section to reveal at least a portion of the tool. The package also has a pair of access openings spaced approximately 180° (i.e. on opposite sides) with respect to each other with each opening being configured to allow manual digital access to the rotatable portion of the tool. This allows the purchaser to grasp and rotate the rotatable section of the tool. The package is also provided with means to restrain the non-rotatable member of the tool from rotation when the rotatable member is rotated. Thus a person can manipulate a tool while the tool remains enclosed in its package and is protected.

DESCRIPTION OF THE PREFERRED EMBODIMENT

Figure 1:
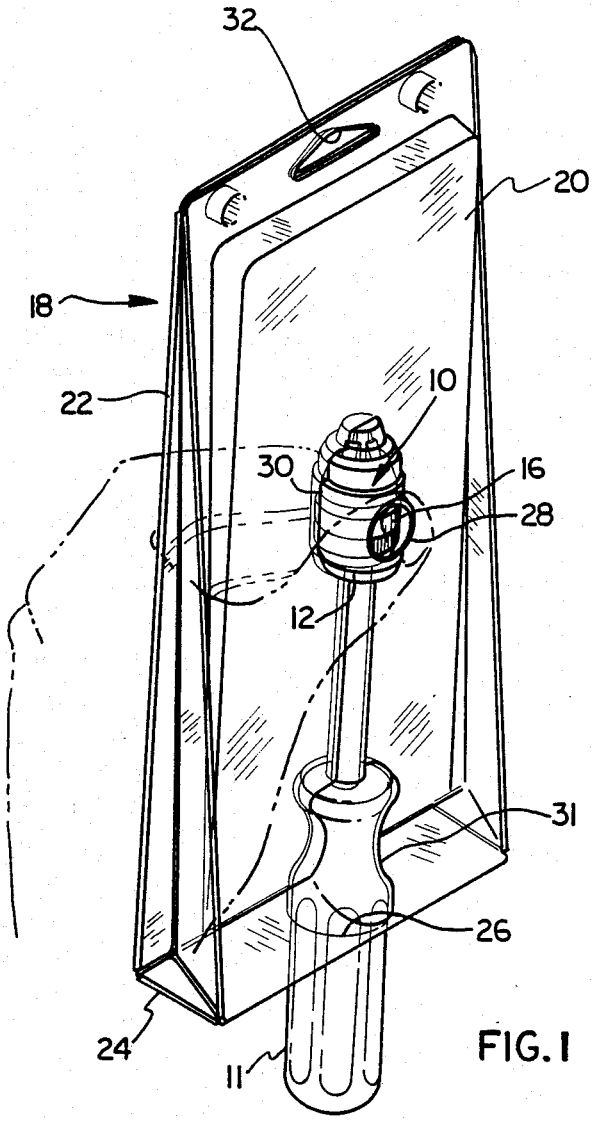
FIG. 1 is a perspective view of one embodiment of a tool and package according to this invention.
Figure 2:
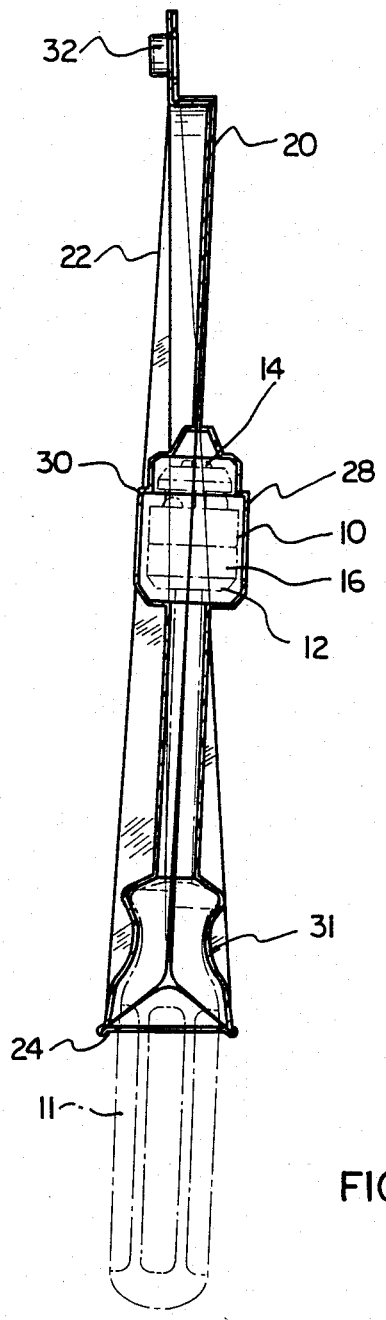
FIG. 2 is a side elevational view of the tool and package of FIG. 1.

Referring now to the drawing and for the present to FIGS. 1 and 2, one embodiment of this invention is shown in which an adjustable nut driver 10 is packaged together with its operating handle 11. In this embodiment the nut driver 10 includes a socket 12 which coacts with jaws 14 which can be opened and closed by the rotation of barrel 16. The tool is a conventional prior art tool and does not per se constitute the invention.

To protect the tool from dust and moisture, and further to allow for the inclusion of advertising or instructional materials, the tool is contained within a package 18. The package 18 is comprised of a front panel 20, a rear panel 22 and a bottom panel 24. These panels are formed of a clear plastic material preferably polyvinyl chloride and are secured together by electronic sealing or by a suitable adhesive, or by mechanical means such as staples or otherwise around the outer marginal edges to form a package enclosing the tool.

The lower or bottom panel 24 has formed therein an opening 26 through which the handle 11 extends. The handle 11 at one end thereon engages the socket 12 in a driving relationship and the other end of the handle extends outside of the package.

The front panel 20 is provided with an opening 28 and a rear panel 22 is provided with an opening 30 spaced opposite (or 180°) with respect to opening 28. The openings 28 and 30 are of a size and shape that allow a prospective purchaser or customer to grasp the barrel 16 of the tool 10 (as shown in FIG. 1) and while grasping the handle 11 rotate the barrel to observe the action of the jaws. To prevent the handle from being withdrawn from the package the panels 20 and 22 are molded to the shape as shown at 31 which conforms in shape to the indented portion of the handle to prevent its removal from the socket and hence from the package. Thus the prospective buyer can observe the action of the adjustable nut driver or other tool while the tool is safely maintained within the package 18. A card or other printed or graphic material can be placed within the package 18 between the front panel 20 and the rear panel 22 which can contain instructions, advertising material and/or other necessary information for the customer the showing thereof being omitted for clarity of illustration.

An aperture 32 is formed at the top of the package to allow the packaged tool to be hung on a rack in a conventional manner.

Figure 3:
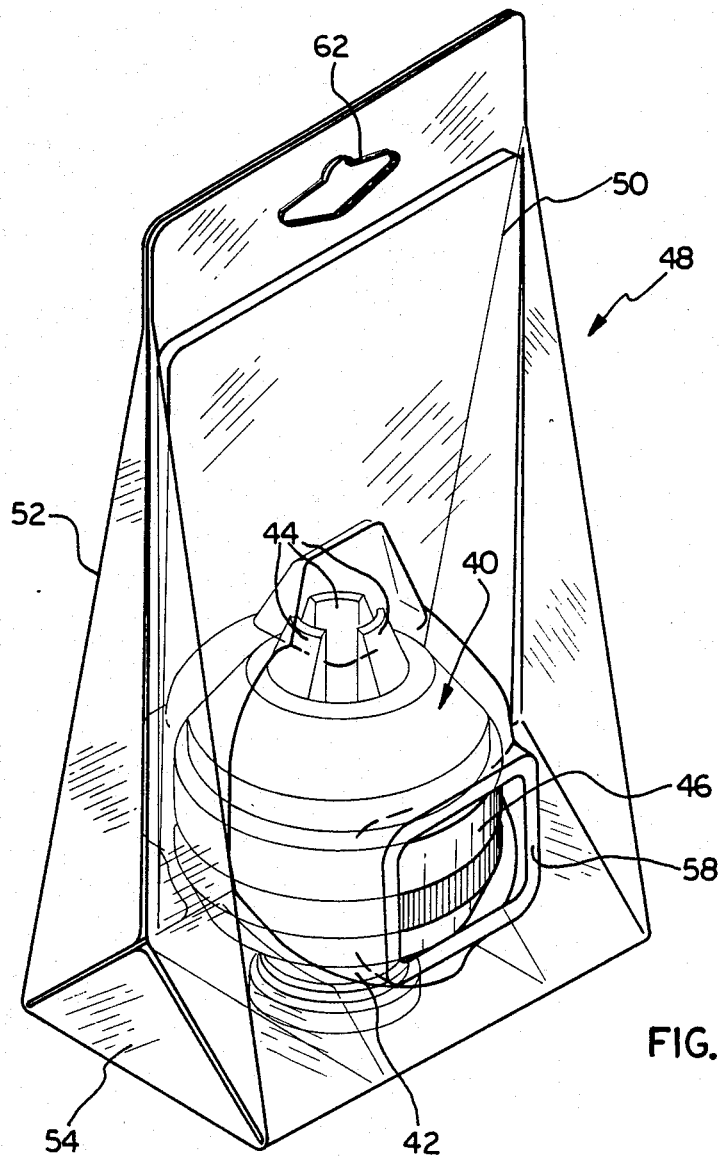
FIG. 3 is a perspective view of another embodiment of a tool and package according to this invention.
Figure 4:
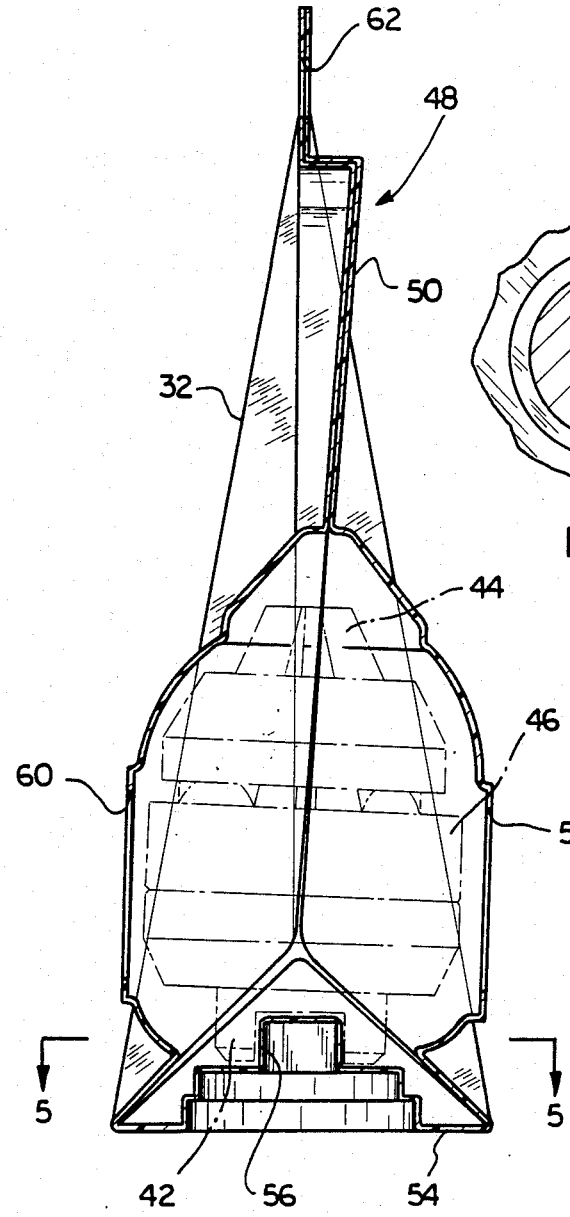
FIG. 4 is a side elevational view of the tool and package of FIG. 3.
Figure 5:
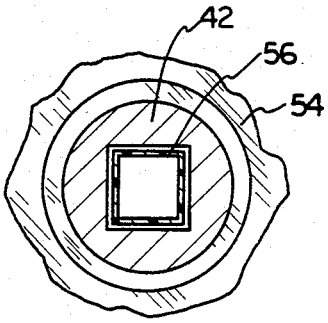
FIG. 5 is a sectional view taken substantially along the plane designated by Line 5—5 of FIG. 4.

Referring now to FIGS. 3, 4 and 5 another embodiment of a tool and package according to this invention is shown. As in previous embodiment, a tool 40 is an adjustable nut driver adapted to be secured to a handle (not shown) for driving various size nuts. In this embodiment the handle is not a part of the package. The nut driver 40 includes a relatively non-rotatable or stationary socket section 42 having square recess for the reception of a handle. The socket section coacts with jaws 44 which jaws can be opened and closed to accommodate various size nuts. The jaws are moved between their open and closed positions by means of a rotatable barrel portion 46 which when rotated while maintaining the socket portion stationary, will move the jaws 44 to various positions. Again as in the previous embodiment, it is to be understood that the adjustable nut driver 40 is a conventional tool and does not per se constitute the invention.

As in the previous embodiment, the driver 40 is packaged within a package 48 for the purpose of protecting the parts from dust and dirt and moisture and further for allowing packaging of instructions and display of various advertising materials. The package 48 is comprised of a front panel 50, a rear panel 52 and a bottom panel 54 which are all formed of a clear self-supporting plastic material such as a clear polyvinyl chloride. The panels 50, 52 and 54 are shaped and formed so that together they conform generally to the shape of the tool 40 and retain the tool 40 inside thereof. The bottom panel 54 is also molded with a square portion 56 which extends into the rectangular recess of the socket 42 which prevents the rotation of the socket. The panels 50, 52 and 54 are sealed together along their outer marginal edges by electronic sealing or by adhesives, or by mechanical means such as staples or otherwise to form a unitary package structure in which the tool 40 is contained and which excludes dust and moisture from the tool.

The front panel 50 is provided with a front panel opening 58 and the rear panel 52 is provided with a rear panel opening 60 located generally on opposite sides of each other. As in the previous embodiment the openings 58 and 60 are so positioned and shaped that a prospective purchaser can grasp the barrel 46 with his or her thumb and forefinger and rotate the barrel. In this embodiment, the insert 56 restrains the socket 42 from rotation. For display purposes, an aperture 62 is formed at the top of the package so that it may be hung on a hook for display in conventional type store display racks. Alternatively, the package can be supported on a shelf on its bottom panel 54.

The type of packaging shown which utilizes the self-supporting polyvinyl chloride is known as shell type packaging and is the preferred technique of packaging, with bonding of the materials being performed either electronically, or by adhesives, or by mechanical means such as staples or by other processes which will reflow and seal the material. This packaging material also is capable of maintaining its shape independently and thus it can act as the structural member of the package as well as providing for the covering and the visual observation of the product. However, other types of packaging including skin packaging and blister packaging can be utilized. Skin packaging or blister packaging normally is done in combination with a cardboard backing or the like, the important thing being that at least a portion of the package be transparent to allow visual observation of the packaged tool and that there be openings provided on opposite sides of the packaging spaced about 180° apart from each other to allow a prospective purchaser to manually grasp the rotatable portion of the packaged tool.

With this type of packaging, which allows the prospective purchaser to try the operation of the tool, there is a significantly reduced likelihood that a person will tear open the package to try the tool. When this happens, tools often aren't returned to the package and the tools may become lost or otherwise disappear.

While several embodiments of this invention have been shown and described, various adaptations and modifications can be made without departing from the scope of the invention as defined in the appended claims.

What is claimed is:

1. In combination a tool having a rotatable member and a non-rotatable member, said rotatable member being generally tubularly shaped and axially rotatable on said non-rotatable member, and a package enclosing said tool, said package having at least one transparent section to reveal at least a portion of said tool, said package having a pair of access openings, said access opening being configured and circumferentially spaced around the package with respect to each other to allow manual digital access to circumferentially spaced portions of said rotatable member of said tool;

and means to restrain said non-rotatable member from rotation upon rotation of said rotatable member;

whereby a person can rotatively manipulate a tool while said tool remains enclosed in its package.

2. The invention as defined in claim 1 wherein said one transparent section is adapted to conform generally in shape to the contour of said tool.

3. The invention as defined in claim 1 wherein said means to restrain said non-rotatable member includes means formed in said package to coact with said non-rotatable member of said tool.

4. The invention as define in claim 1 wherein said non-rotatable member of said tool has socket means formed therein, and said means formed on said package to coact with the non-rotatable member includes an insert disposed in said socket means and coatable therewith.

5. The invention as defined in claim 1 wherein said means to restrain said non-rotatable member includes handle means coactable with said non-rotatable member;

and means formed in said package to mount said handle for extension from said tool outside said package, whereby a person may grasp said handle means while rotating said rotatable member of the tool.

6. The invention as defined in claim 5 wherein said non-rotatable member includes a socket, and said handle is inserted in said socket.

7. The invention as defined in claim 6 wherein said package includes opening means conforming to a portion of said handle to prevent withdrawal of the handle from the package.

8. The invention as defined in claim 1 wherein said package includes means to mount the packaged tool on a rack.

9. The invention as defined in claim 1 wherein said package material is a self-supporting transparent plastic material.

10. The invention as defined in claim 9 wherein the package material is polyvinyl chloride.

* * * * *